US008191889B1

(12) United States Patent
Cummings et al.

(10) Patent No.: US 8,191,889 B1
(45) Date of Patent: Jun. 5, 2012

(54) METHOD AND APPARATUS FOR MAINTAINING A PREDETERMINED MEDIA STACK HEIGHT IN A MEDIA TRAY USED IN AN IMAGE PRODUCTION DEVICE

(75) Inventors: Liam S. Cummings, Macedon, NY (US); Robert L. Dengler, Webster, NY (US); John M. Viavattine, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/084,219

(22) Filed: Apr. 11, 2011

(51) Int. Cl.
*B65H 1/08* (2006.01)
*B65H 1/16* (2006.01)

(52) U.S. Cl. ..... 271/147; 271/148; 271/155

(58) Field of Classification Search ..... 271/147, 271/148, 155, 22, 24, 30.1, 31, 126, 128, 271/130, 152
See application file for complete search history.

(56) References Cited

U.S. PATENT DOCUMENTS 3,951,264 A * 4/1976 Heidecker et al. ..... 206/308.3
4,582,463 A * 4/1986 Schreiner ..... 414/796.7
6,837,490 B2 * 1/2005 Hirai et al. ..... 271/148

* cited by examiner

*Primary Examiner* — David H Bollinger
(74) *Attorney, Agent, or Firm* — Ronald E. Prass, Jr.; Prass LLP

(57) ABSTRACT

A method and apparatus for maintaining level media stack in a media tray used in an image production device is disclosed. The method may include receiving a stack of media sheets on top of a plurality of selectively-controllable inflatable bladders located in the media tray, and maintaining a level media stack by inflating or deflating one or more of the plurality of selectively-controllable inflatable bladders.

18 Claims, 5 Drawing Sheets

METHOD AND APPARATUS FOR MAINTAINING A PREDETERMINED MEDIA STACK HEIGHT IN A MEDIA TRAY USED IN AN IMAGE PRODUCTION DEVICE

BACKGROUND

Disclosed herein is a method and apparatus for maintaining a level media stack in a media tray used in an image production device that uses a plurality of selectively-controllable inflatable bladders in the base of a feed tray and corresponding stacker base, as well as the corresponding apparatus and computer-readable medium.

The structure of certain types of customized media, such as Docucards, creates a height bias from end to end when stacked in the feed tray as well as the output in the stacker. Without assistance feeding of such media from the feed tray is difficult at best, and any success can only result from a small stack in the tray. This requires excessive reloading of the tray. The most common work around today is the use of cardboard shims to compensate for the uneven stack level in the feed tray, but that is limited for effective capacity (100-200 sheets). Since these shims are customized by the operator, the same level of success cannot be counted on from operator to operator and is dependent on the operator's patience, skill, and understanding of the problem. Another option, available through CAS, is the DocuCard enablement kit for iGen. This is also limited in the number of sheets that can be stacked for successful feeding (250 sheets), and is not robust enough to handle different configurations (card placement on the sheets).

SUMMARY

A method and apparatus for maintaining level media stack in a media tray used in an image production device is disclosed. The method may include receiving a stack of media sheets on top of a plurality of selectively-controllable inflatable bladders located in the media tray, and maintaining a level media stack by inflating or deflating one or more of the plurality of selectively-controllable inflatable bladders.

DETAILED DESCRIPTION

Figure 1:
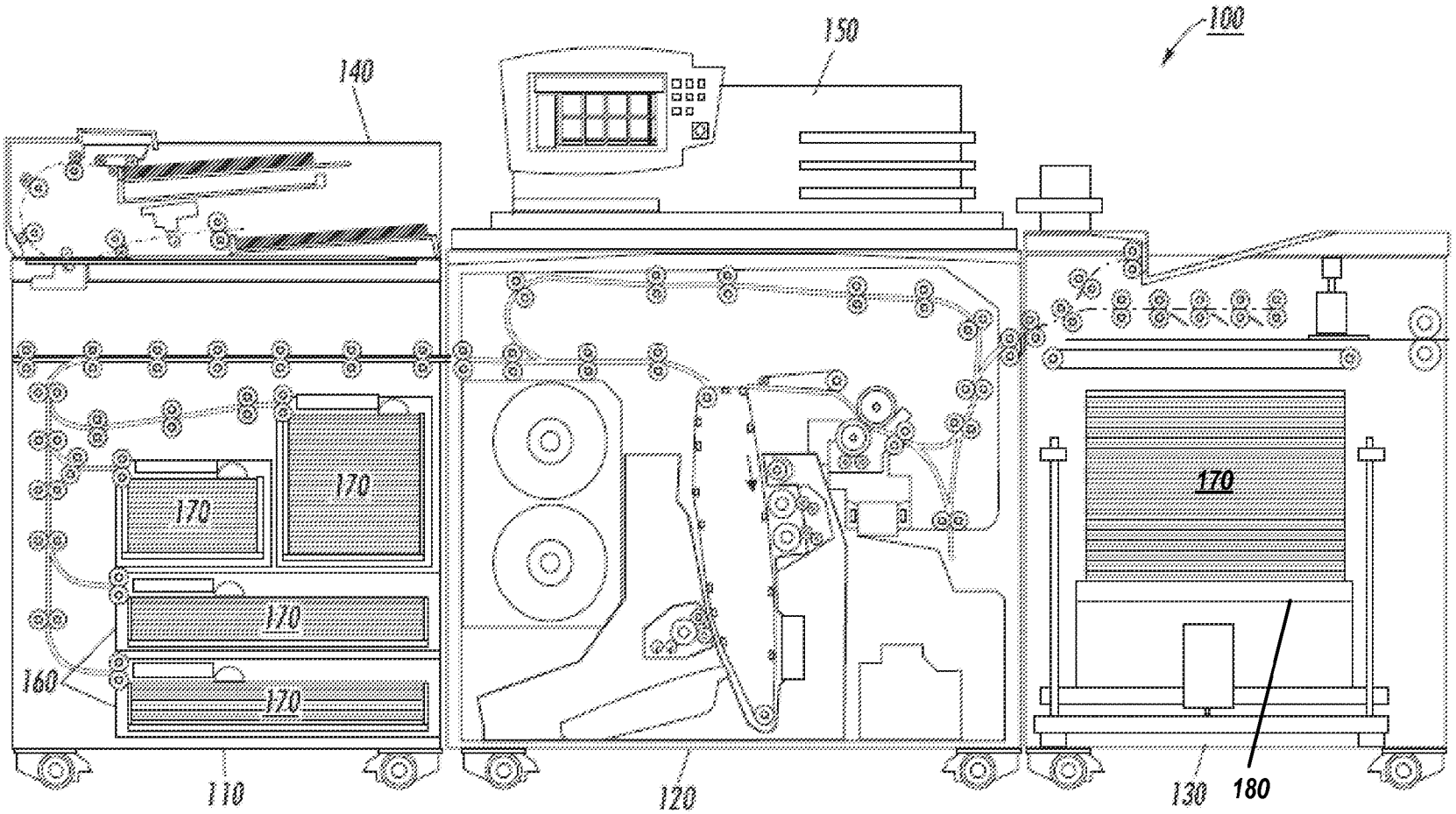
FIG. 1 is an exemplary diagram of an image production device in accordance with one possible embodiment of the disclosure.

Aspects of the embodiments disclosed herein relate to a method for maintaining a level media stack in a media tray used in an image production device, as well as corresponding apparatus and computer-readable medium.

The disclosed embodiments may include a method for maintaining a level media stack in a media tray used in an image production device, the media tray being one of a media feed tray and a media stacking tray. The method may include receiving a stack of media sheets on top of a plurality of selectively-controllable inflatable bladders located in the media tray, and maintaining a level media stack by inflating or deflating one or more of the plurality of selectively-controllable inflatable bladders.

The disclosed embodiments may further include an image production device having a media tray, wherein the media tray is one of a media feed tray and a media stacking tray, a plurality of selectively-controllable inflatable bladders located inside the media tray, and a media stack level control unit that receives a stack of media sheets on top of the plurality of selectively-controllable inflatable bladders located in the media tray, and maintains a level media stack by inflating or deflating the inflatable bladder.

The disclosed embodiments may further include a computer-readable medium storing instructions for controlling a computing device for maintaining a level media stack in a media tray used in an image production device, the media tray being one of a media feed tray and a media stacking tray. The instructions may include receiving a stack of media sheets on top of a plurality of selectively-controllable inflatable bladders located in the media tray, and maintaining a level media stack by inflating or deflating one or more of the plurality of selectively-controllable inflatable bladders.

The disclosed embodiments may concern using an inflatable bladder that is divided into several cells (or a plurality of selectively-controllable inflatable bladders which is the same or equivalent) in the base of the feed tray and corresponding stacker. Each of the plurality of selectively-controllable inflatable bladders may have its own valve control. Each of the plurality of selectively-controllable inflatable bladders may be independently inflated or deflated to allow stack balancing and leveling across a wide range of configurations where the number of cards and their locations on a sheet may vary.

The process of the disclosed embodiments is different than simply measuring and maintaining just the media stack height. One or more of the plurality of selectively-controllable inflatable bladders is inflated or deflated to maintain a "flatness" or "levelness" of the media stack.

Media stack level uniformity may be detected through the use of light sources (e.g., lasers, light-emitting diodes (LEDs), etc.) across the surface of the top sheet. When the reception of the light beam is obstructed, this may indicate that one or more of the plurality of selectively-controllable bladders need to be inflated or deflated. The inflating or deflating may continue until the reception of the light beam is acknowledged. The bias of a full tray may change as the numbers of sheets are reduced during the run. The interactive monitoring throughout the run may assure a level media stack, resulting in reliable feeding or stacking for the entire job without added operator intervention. For some embodiments, instead of using the light beams, it may be possible to use sensors, actuators or other leveling mechanisms, for example.

FIG. 1 is an exemplary diagram of an image production device in accordance with one possible embodiment of the disclosure. The image production device 100 may be any device that may be capable of making image production documents (e.g., printed documents, copies, etc.) including a copier, a printer, a facsimile device, and a multi-function device (MFD), for example.

The image production device 100 may include an image production section 120, which includes hardware by which image signals are used to create a desired image, as well as a stand-alone feeder section 110, which stores and dispenses sheets on which images are to be printed, and an output section 130, which may include hardware for stacking, folding, stapling, binding, etc., prints which are output from the marking engine. If the printer is also operable as a copier, the printer further includes a document feeder 140, which operates to convert signals from light reflected from original hard-copy image into digital signals, which are in turn processed to create copies with the image production section 120. The image production device 100 may also include a local user interface 150 for controlling its operations, although another source of image data and instructions may include any number of computers to which the printer is connected via a network.

With reference to feeder section 110, the module includes any number of trays 160, each of which stores a media stack 170 or print sheets ("media") of a predetermined type (size, weight, color, coating, transparency, etc.) and includes a feeder to dispense one of the sheets therein as instructed. Certain types of media may require special handling in order to be dispensed properly. For example, heavier or larger media may desirably be drawn from a media stack 170 by use of an air knife, fluffer, vacuum grip or other application (not shown in the Figure) of air pressure toward the top sheet or sheets in a media stack 170. Certain types of coated media are advantageously drawn from a media stack 170 by the use of an application of heat, such as by a stream of hot air (not shown in the Figure). Sheets of media drawn from a media stack 170 on a selected tray 160 may then be moved to the image production section 120 to receive one or more images thereon. Then, the printed sheet is then moved to output section 130, where it may be collated, stapled, folded, etc., with other media sheets in manners familiar in the art. The printed media may be place on a media stacker 180, for example.

Figure 2:
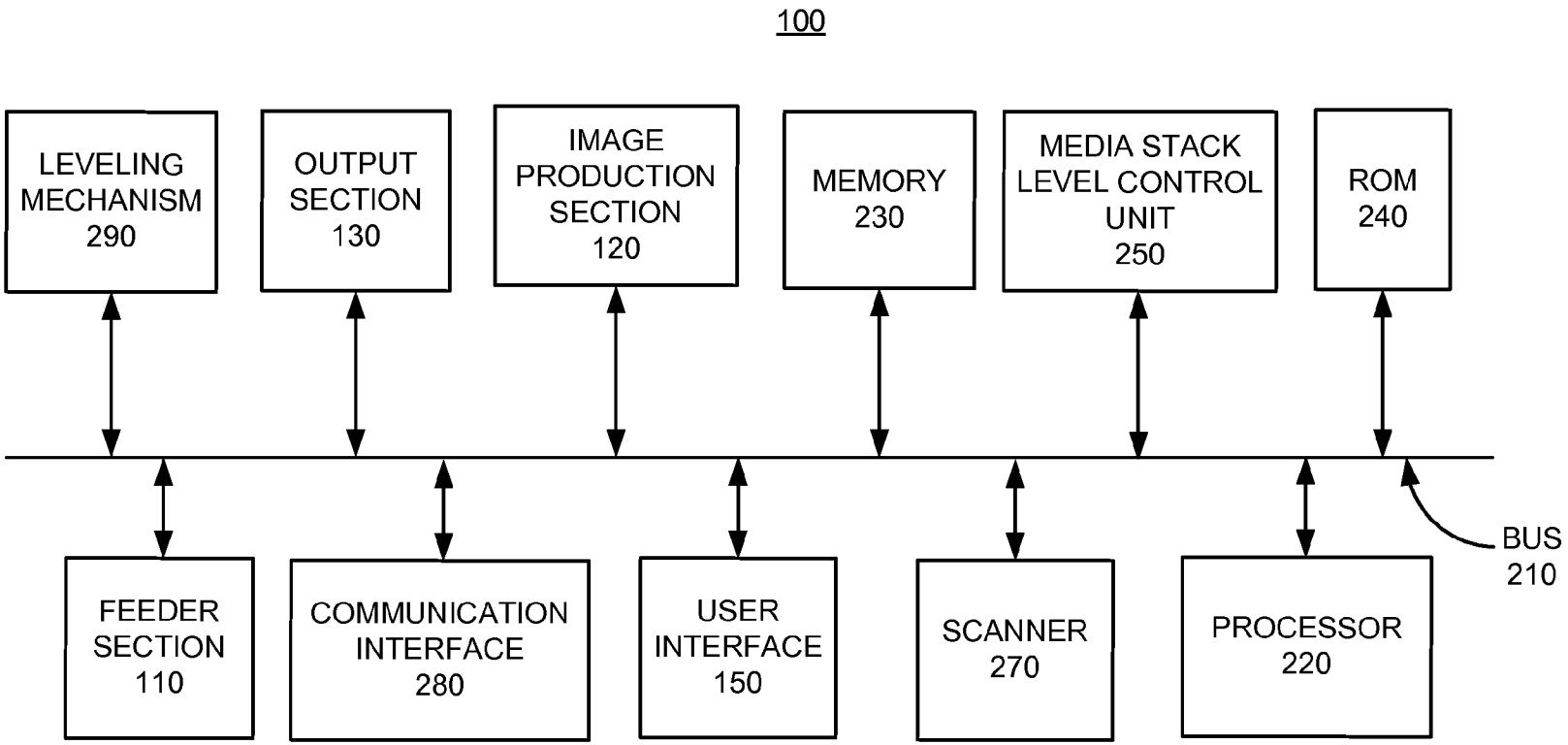
FIG. 2 is an exemplary block diagram of the image production device in accordance with one possible embodiment of the disclosure.

FIG. 2 is an exemplary block diagram of the processing logic of the image production device in accordance with one possible embodiment of the disclosure. The image production device 100 may include a bus 210, a processor 220, a memory 230, a read only memory (ROM) 240, a media stack level control unit 250, a feeder section 110, an output section 130, a user interface 150, a communication interface 280, an image production section 120, a scanner 270, and a leveling mechanism 290. Bus 210 may permit communication among the components of the image production device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 150 may include one or more conventional mechanisms that permit a user to input information to and interact with the image production unit 100, such as a keyboard, a display, a mouse, a pen, a voice recognition device, touchpad, buttons, etc., for example. Output section 130 may include one or more conventional mechanisms that output image production documents to the user, including output trays, output paths, finishing section, etc., for example. The image production section 120 may include an image printing and/or copying section, a scanner, a fuser, etc., for example.

The scanner 270 (or image scanner) may be any scanner known to one of skill in the art, such as a flat-bed scanner, document feeder scanner, etc. The image scanner 270 may be a common full-rate half-rate carriage design and can be made with high resolution (600 dpi or greater) at low cost, for example.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The image production device 100 illustrated in FIGS. 1-2 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

Operation of the leveling mechanism 290 will be discussed below in relation to FIGS. 3-5 and the operation of the media stack level control unit 250 will be discussed in relation to the flowchart in FIG. 5, for example.

Figure 3:
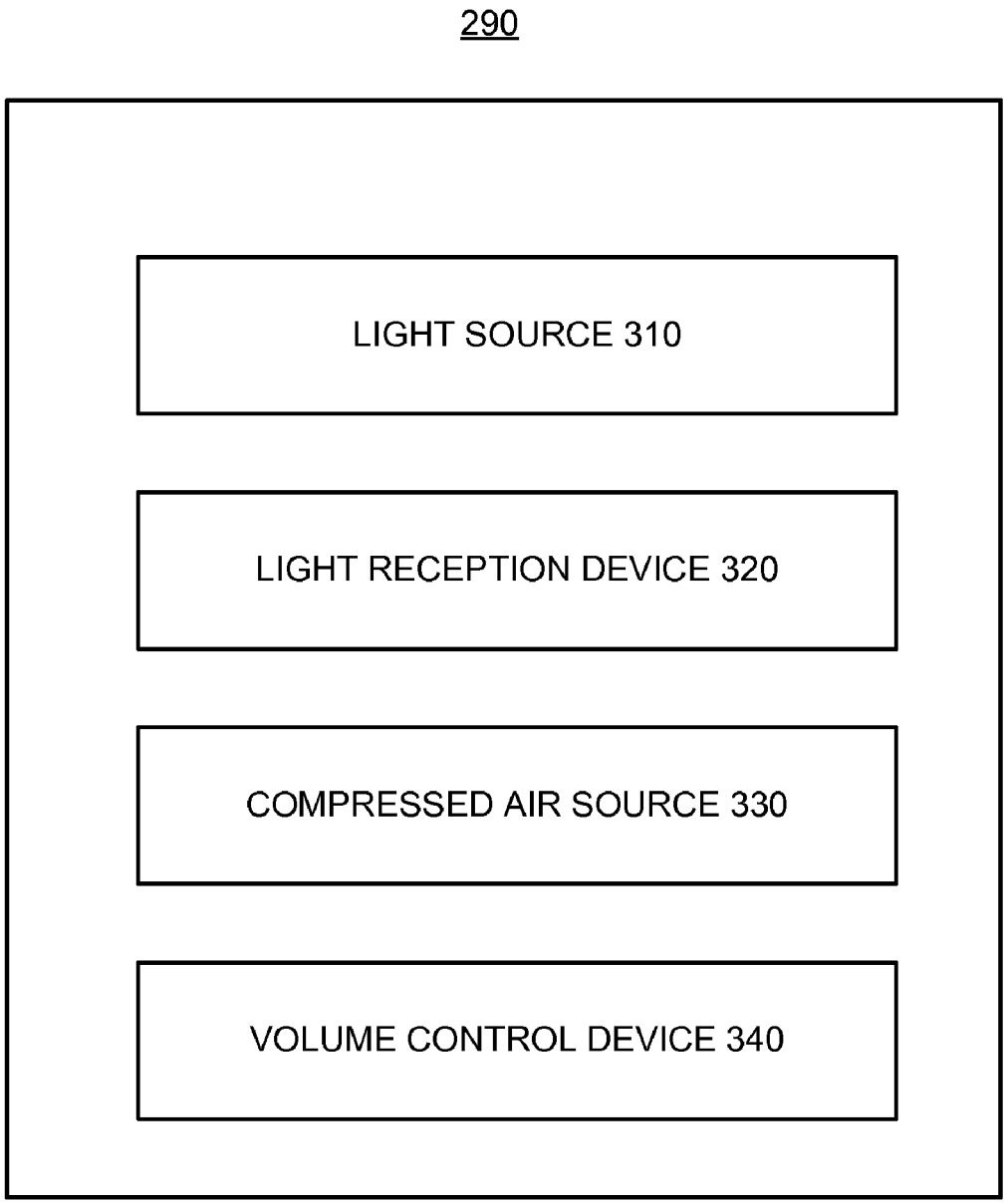
FIG. 3 is an exemplary diagram that illustrates components of a possible leveling mechanism in accordance with one possible embodiment of the disclosure.

FIG. 3 is an exemplary diagram that illustrates components of a possible leveling mechanism 290 in accordance with one possible embodiment of the disclosure. The components of the possible leveling device may include light source 310, light reception unit 320, compressed air source 330, and volume control 340. The components may be used with the media feed tray 160 or media stacker 180 and may include a light source 310 to direct the light beams across the surface of the top sheet of the media stack 170. The light source 310 may be a laser, an LED, sensor, or other source of light known to one of skill in the art. Moreover, other forms of detections of media sheets may be used such as a sensor, sensor array, etc. Light reception unit 320 may any device that may be used to receive the light beams from the light source 310. The light reception unit 320 may be able to send signals or sense that the expected light beam was not received or received in a degraded or diminished strength.

As described below with respect to FIGS. 4B and 4C, depending on how the stack of sheets is positioned, the reception of the light beams may be obstructed or acknowledged. Compressed air source 330 may be any device that may be used to inflate the cells of the inflatable bladder (or one or more of a plurality of selectively-controllable inflatable bladders) to enable the top sheet of the media stack 160 to be leveled. Volume control 340 may be associated with the plurality of selectively-controllable inflatable bladders and may be used to control the volume of the plurality of selectively-controllable inflatable bladders. The volume control 340 may be comprised of individual valves to control the volume of each of the plurality of selectively-controllable inflatable bladders.

Figure 4A:
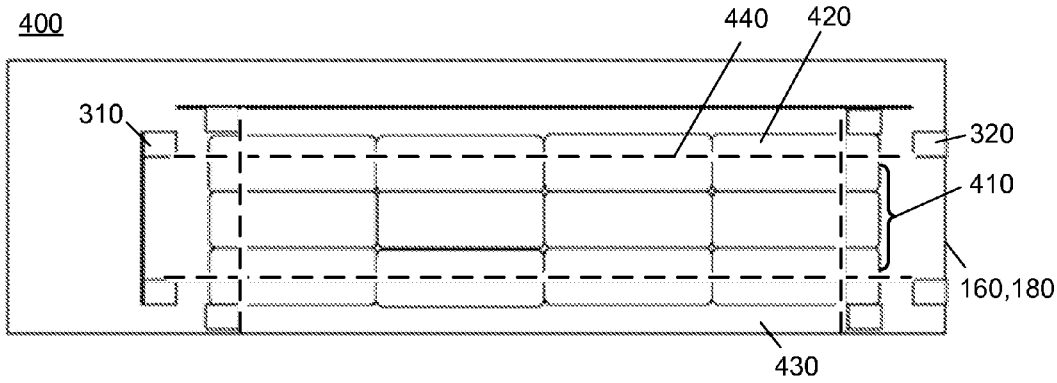
FIGS. 4A, 4B and 4C are exemplary block diagrams that illustrate the inflatable bladders in accordance with one possible embodiment of the disclosure.
Figure 4B:
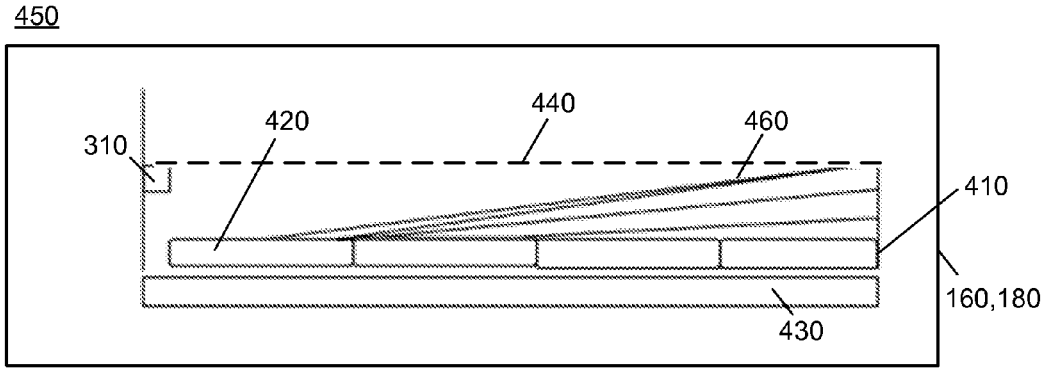
Figure 4C:
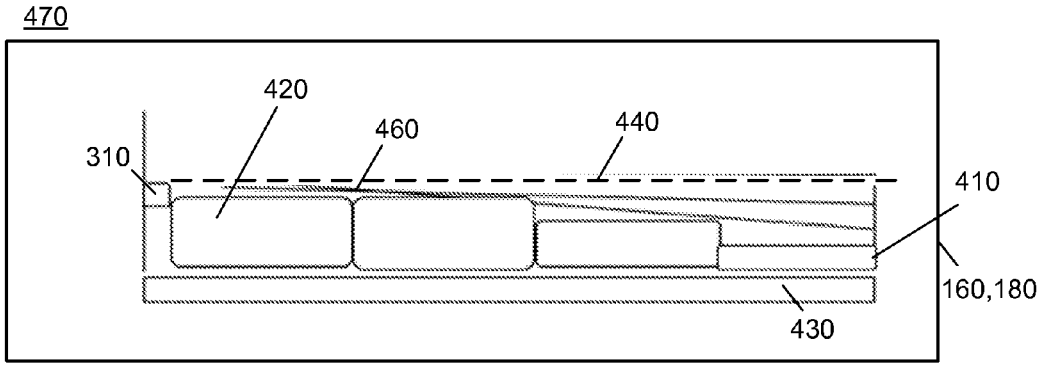

FIGS. 4A, 4B and 4C are exemplary block diagrams that illustrate the plurality of selectively-controllable inflatable bladders 410 in accordance with one possible embodiment of the disclosure. FIG. 4A is an exemplary block diagram that illustrates a top view 400 of a media feed tray 160 or a media stacker 180 in accordance with one possible embodiment of the disclosure. The media feed tray 160 or media stacker 180 may include a plurality of selectively-controllable inflatable bladders 410 in its base 430. The inflatable bladder 410 may have one or more individual cells 420 or may be a plurality of selectively-controllable inflatable bladders 410 with individual bladders or cell 420. In the current example, the plurality of selectively-controllable inflatable bladders 410 may include twelve (12) individually-controllable bladders 420. However, the number of cells (or bladders) 420 may vary as known to one of skill in the art.

Each of the cells 420 may be independently inflated or deflated using their own volume control devices 340. The volume control device 340 may be a valve, for example. Compressed air form the compressed air source 330 may be used to increase the volume of each of the cells 420. A stack of media sheets 170 may be placed on top of the plurality of selectively-controllable inflatable bladders 410 and the leveling of the media stack 170 may be controlled using the plurality of selectively-controllable inflatable bladders 410.

A leveling mechanism 290 may be used to provide feedback whether a surface of a top media sheet of the media stack 170 is level. The leveling mechanism 290 may be implemented using sensors, actuators, the light source 310, or any other techniques. In the current example, four light sources 310 may be used—two along the longitudinal axis of the media feed tray 160 or media stacker 180, and two along the latitudinal axis of the media feed tray 160 or media stacker 180. An exemplary light beam is shown by the dotted line in the figures.

Each of the four light sources 310 may be associated with a light reception device 320 that may be configured to receive the light beams from the light source 310 when it is directed horizontally across a surface of a top sheet of the media stack 170. When the surface of the top sheet is generally, it may be said that the stack of sheets has uniformed height, and the reception of the four light sources 310 are detected by their light reception device 320. When the surface of the stop sheet is irregular or not generally flat, it may be indicate that the media stack 170 has irregular or non-uniformed height which may obstruct the reception device 320 to receive the light beam 440 from the light source 310.

FIG. 4B is an exemplary block diagram that illustrates a side view 450 of a media feed tray 160 or a media stacker 180 in accordance with one possible embodiment of the disclosure. The plurality of selectively-controllable inflatable bladders may be positioned in the base 430 of the media feed tray 160 or media stacker 180. Light source 310 may be one of the four light sources 310 illustrated in FIG. 4A, for example. In this example, the top media sheet 460 of the media stack 170 is skewed on one end and not leveled at the top. This may cause the reception of the light beam 440 of one or more of the four light sources 310, to be obstructed, for example.

FIG. 4C is an exemplary block diagram that illustrates another side view 470 of a media feed tray 160 or a media stacker 180 in accordance with one possible embodiment of the disclosure. Some of the cells or individual bladders 420 of the plurality of selectively-controllable inflatable bladders 410 may be inflated to adjust the lack of height uniformity of the media stack 170 illustrated in FIG. 4B. In this example, the cells or bladders 420 may be inflated to enable the media stack 170 to be more leveled at the top. It may be noted that the volume of the cells or individual bladders 420 may be different from the volume of other cells or bladders 420. This may cause the reception of all of the four light beams 440 from the four light sources 310 to be acknowledged by its respective light reception device 320. Note that both the plurality of selectively-controllable inflatable bladders 410 and the light sources 310 may be arranged in two-dimensional arrays to facilitate detection of a media sheet that indicates that the media stack 170 is not level, for example.

Figure 5:
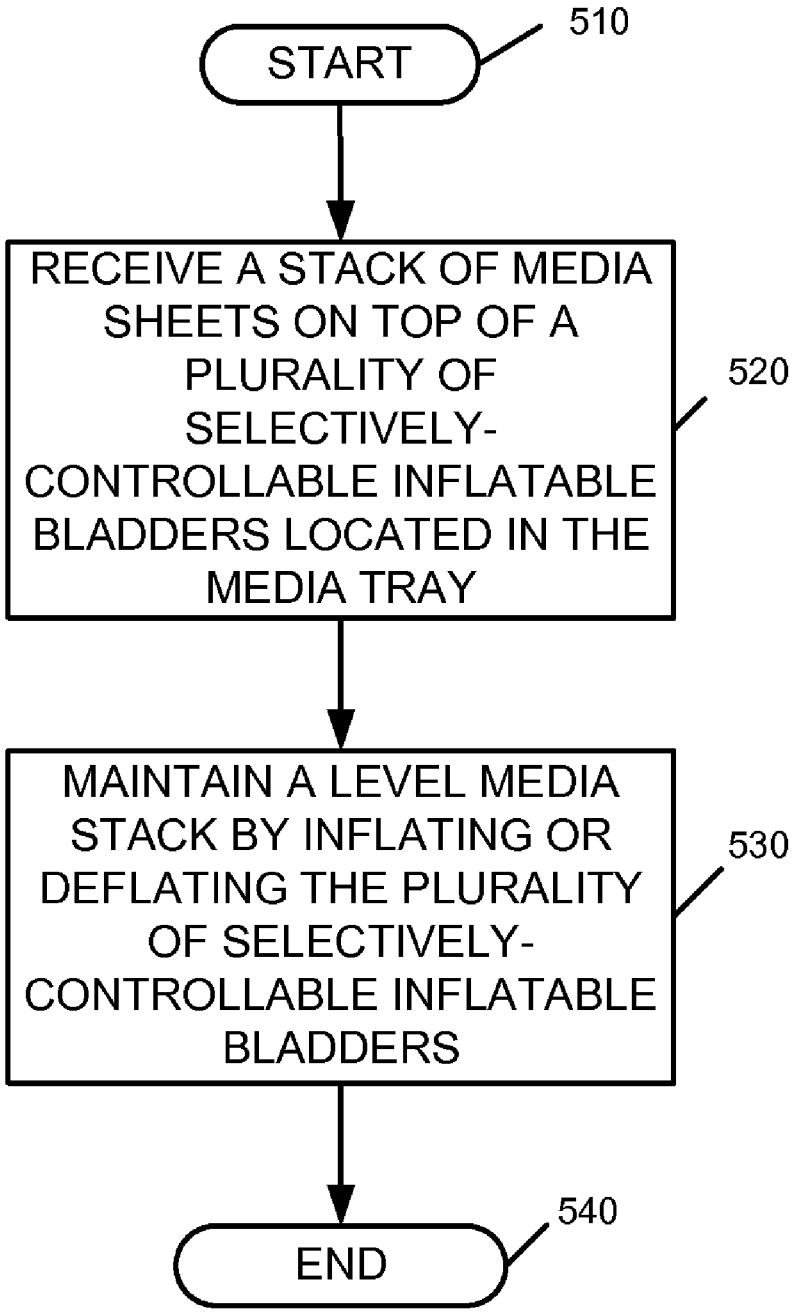
FIG. 5 is a flowchart of a media stack level control process in accordance with one possible embodiment of the disclosure.

FIG. 5 is a flowchart of a media stack level control process in accordance with one possible embodiment of the disclosure. The method may begin at step 510 and may continue to step 520 where the media stack level control unit 250 may receive a media stack 170 on top of a plurality of selectively-controllable inflatable bladders 410 located in the media tray 160, 180, where the media tray may be either a media feed tray 160 or a media stacking tray 180, for example.

At step 530, the media stack level control unit 250 may maintain the media stack 170 level by inflating or deflating the plurality of selectively-controllable inflatable bladders 410. The plurality of selectively-controllable inflatable bladders 410 may include multiple cells or bladders 420 and the level of the media stack 170 may be maintained by inflating or deflating one or more cells or bladders 420 of the plurality of selectively-controllable inflatable bladders 410. In this manner, each of the multiple cells or bladders 420 may have its own valve (or volume) control 340 and each of the multiple cells or bladders 420 may be configured to be independently inflated or deflated, for example. The levelness of the media stack 170 may be determined or predetermined by a user moving the one or more light sources 310 and respective light reception devices 320, or may be preset be the manufacturer or distributor, for example.

The levelness of the media stack 170 may be maintained by using a leveling mechanism 290, for example. The leveling mechanism 290 may include one or more light sources 310 which may apply light beams 440 across a surface of a top sheet of the media stack 170 and one or more of the multiple cells or bladders 420 (of the plurality of selectively-controllable inflatable bladders 410) may be inflated or deflated based on a reception of a signal that one or more light beams 440 across the surface of the top sheet is being obstructed. That signal may be the non-receipt or reduced strength of receipt of the light beam 440 from the light source 410 by the light reception device 420, for example. The process may then go to step 540 and end.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for maintaining a level media stack in a media tray used in an image production device, the media tray being one of a media feed tray and a media stacking tray, the method comprising:

receiving a stack of media sheets on top of a plurality of selectively-controllable inflatable bladders located in the media tray, wherein each of the plurality of selectively-controllable inflatable bladders has its own valve control and each of the plurality of selectively-controllable inflatable bladders is configured to be independently inflated or deflated; and maintaining a level media stack by inflating or deflating one or more of the plurality of selectively-controllable inflatable bladders.

2. The method of claim 1, wherein the plurality of selectively-controllable inflatable bladders are inflated using compressed air.

3. The method of claim 1, wherein the plurality of selectively-controllable inflatable bladders are arranged in a two-dimensional array.

4. The method of claim 1, wherein the level media stack is maintained by using a leveling mechanism.

5. The method of claim 4, wherein the leveling mechanism includes one or more light sources which apply a light beam across a surface of a top sheet of the media stack and one or more of the plurality of selectively-controllable inflatable bladders is inflated or deflated based on a reception of a signal that one or more light beams across the surface of the top sheet is being obstructed.

6. The method of claim 1, wherein the image production device is one of a copier, a printer, a facsimile device, and a multi-function device.

7. An image production device, comprising:

a media tray, wherein the media tray is one of a media feed tray and a media stacking tray;

a plurality of selectively-controllable inflatable bladders located inside the media tray, wherein each of the plurality of selectively-controllable inflatable bladders has its own valve control and each of the plurality of selectively-controllable inflatable bladders is configured to be independently inflated or deflated; and a media stack level control unit that receives a stack of media sheets on top of the plurality of selectively-controllable inflatable bladders located in the media tray; and maintains a level media stack by inflating or deflating the inflatable bladder.

8. The image production device of claim 7, wherein the plurality of selectively-controllable inflatable bladders are inflated using compressed air.

9. The image production device of claim 7, wherein the plurality of selectively-controllable inflatable bladders are arranged in a two-dimensional array.

10. The image production device of claim 7, further comprising:

a leveling mechanism, wherein the level media stack is maintained by using the leveling mechanism.

11. The image production device of claim 10, wherein the leveling mechanism includes one or more light sources which apply a light beam across a surface of a top sheet of the media stack and one or more of the plurality of selectively-controllable inflatable bladders is inflated or deflated based on a reception of a signal that one or more light beams across the surface of the top sheet is being obstructed.

12. The image production device of claim 7, wherein the image production device is one of a copier, a printer, a facsimile device, and a multi-function device.

13. A non-transitory computer-readable medium storing instructions for controlling a computing device for maintaining a level media stack in a media tray used in an image production device, the instructions comprising:

receiving a stack of media sheets on top of a plurality of selectively-controllable inflatable bladders located in the media tray, wherein each of the plurality of selectively-controllable inflatable bladders has its own valve control and each of the plurality of selectively-controllable inflatable bladders is configured to be independently inflated or deflated; and maintaining a level media stack by inflating or deflating one or more of the plurality of selectively-controllable inflatable bladders.

14. The non-transient computer-readable medium of claim 13, wherein the plurality of selectively-controllable inflatable bladders are inflated using compressed air.

15. The non-transient computer-readable medium of claim 13, wherein the plurality of selectively-controllable inflatable bladders are arranged in a two-dimensional array.

16. The non-transient computer-readable medium of claim 13, wherein the level media stack is maintained by using a leveling mechanism.

17. The non-transient computer-readable medium of claim 16, wherein the leveling mechanism includes one or more light sources which apply a light beam across a surface of a top sheet of the media stack and one or more of the plurality of selectively-controllable inflatable bladders is inflated or deflated based on a reception of a signal that one or more light beams across the surface of the top sheet is being obstructed.

18. The non-transient computer-readable medium of claim 13, wherein the image production device is one of a copier, a printer, a facsimile device, and a multi-function device.

* * * * *